US011551653B2

(12) United States Patent
Komatsu et al.

(10) Patent No.: US 11,551,653 B2
(45) Date of Patent: Jan. 10, 2023

(54) ELECTRONIC MUSICAL INSTRUMENT

(71) Applicant: YAMAHA CORPORATION, Hamamatsu (JP)

(72) Inventors: Akihiko Komatsu, Hamamatsu (JP); Yasuhiko Oba, Hamamatsu (JP); Michiko Tanoue, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 238 days.

(21) Appl. No.: 16/816,811

(22) Filed: Mar. 12, 2020

(65) Prior Publication Data

US 2020/0211519 A1 Jul. 2, 2020

Related U.S. Application Data

(63) Continuation of application No. PCT/JP2017/036168, filed on Oct. 4, 2017.

(51) Int. Cl.

*G10H 1/34* (2006.01)
*G10H 1/053* (2006.01)
*G10H 1/46* (2006.01)

(52) U.S. Cl.

CPC ..... *G10H 1/346* (2013.01); *G10H 1/053* (2013.01); *G10H 1/46* (2013.01); *G10H 2220/226* (2013.01); *G10H 2220/271* (2013.01)

(58) Field of Classification Search

CPC ..... G10H 1/346; G10H 1/053; G10H 1/46; G10H 2220/226
USPC ..... 84/433
See application file for complete search history.

(56) References Cited

U.S. PATENT DOCUMENTS 7,002,068 B2 * 2/2006 Koseki ..... G10H 7/02 84/625
7,514,625 B2 * 4/2009 Suzuki ..... G10H 1/346 84/723
7,917,239 B2 * 3/2011 Aoyagi ..... G06F 1/1671 700/94

(Continued)

FOREIGN PATENT DOCUMENTS

JP 2001249668 A * 9/2001 ..... G10H 1/366
JP 3318790 B2 * 8/2002

(Continued)

OTHER PUBLICATIONS

International Search Report issued in Intl. Appln. No PCT/JP2017/036168 dated Dec. 19, 2017. English translation provided.

(Continued)

*Primary Examiner* — Christina M Schreiber
(74) *Attorney, Agent, or Firm* — Rossi, Kimms & McDowell LLP

(57) ABSTRACT

An electronic musical instrument according to one embodiment includes: a sound source configured to generate a first sound signal and a second sound signal in accordance with an instruction signal for instructing to produce a sound; a first output unit configured to output a third sound signal containing the first sound signal and the second sound signal at a first sound volume ratio; and a second output unit configured to output a fourth sound signal containing the first sound signal and the second sound signal at a second sound volume ratio that is different from the first sound volume ratio.

23 Claims, 7 Drawing Sheets

(56) References Cited

U.S. PATENT DOCUMENTS

| | | | | |
|---|---|---|---|---|
| 7,968,788 | B2 * | 6/2011 | Shinjo | G10H 1/32 84/743 |
| 8,338,688 | B2 * | 12/2012 | Shinjo | G10H 1/346 84/718 |
| 8,901,408 | B2 * | 12/2014 | Nakayama | G10H 1/46 84/718 |
| 2007/0289435 | A1 * | 12/2007 | Tajika | G10H 1/346 84/661 |
| 2009/0241756 | A1 * | 10/2009 | Tajima | G10H 1/32 84/604 |
| 2012/0077592 | A1 * | 3/2012 | Asami | A63F 13/814 463/35 |
| 2012/0209933 | A1 * | 8/2012 | Ridges | H04L 67/131 709/208 |
| 2018/0261196 | A1 * | 9/2018 | Tajika | G10H 1/46 |
| 2019/0387344 | A1 * | 12/2019 | Kim | H04R 5/04 |
| 2020/0211519 | A1 * | 7/2020 | Komatsu | G10H 1/46 |
| 2020/0336857 | A1 * | 10/2020 | Kim | H04S 7/301 |
| 2020/0372888 | A1 * | 11/2020 | Sasaki | G10H 3/143 |
| 2021/0058719 | A1 * | 2/2021 | Chen | H04R 25/558 |
| 2021/0096812 | A1 * | 4/2021 | Dennis | G06F 3/165 |
| 2021/0201869 | A1 * | 7/2021 | Oba | G10H 1/057 |

FOREIGN PATENT DOCUMENTS

| | | | | |
|---|---|---|---|---|
| JP | 2007322871 | A | 12/2007 | |
| JP | 2010249529 | A | * 11/2010 | |
| JP | 2014059534 | A | * 4/2014 | |
| JP | 2014059534 | A | 4/2014 | |
| JP | 2020136746 | A | * 8/2020 | |
| WO | WO-2019092776 | A1 | * 5/2019 | G10H 1/053 |

OTHER PUBLICATIONS

Written Opinion issued in Intl. Appln. No. PCT/JP2017/036168 dated Dec. 19, 2017.

* cited by examiner

ELECTRONIC MUSICAL INSTRUMENT

CROSS-REFERENCE TO RELATED APPLICATIONS

This application is a U.S. continuation application filed under 35 U.S.C. § 111(a), of International Application No. PCT/JP2017/036168, filed on Oct. 4, 2017, the disclosures of which are incorporated by reference.

FIELD

The present invention relates to a technology for generating a sound signal in an electronic musical instrument.

BACKGROUND

Various devices have been designed to make sounds from electronic pianos as close as possible to sounds of acoustic pianos. An example is Patent Literature 1 (Japanese Laid-Open Patent Publication 2014-59534), in which when a key is depressed in playing an acoustic piano, not only is a string striking sound produced, but also a keybed hitting sound is produced along with the depression of the key. In the field of electronic musical instruments such as electronic pianos, technologies for reproducing such keybed hitting sounds have been disclosed.

SUMMARY

According to an embodiment of the present invention, there is provided an electronic musical instrument including a sound source configured to generate a first sound signal and a second sound signal in accordance with an instruction signal for instructing to produce a sound, a first output unit configured to output a third sound signal containing the first sound signal and the second sound signal at a first sound volume ratio, and a second output unit configured to output a fourth sound signal containing the first sound signal and the second sound signal at a second sound volume ratio that is different from the first sound volume ratio.

According to an embodiment of the present invention, there is provided an electronic musical instrument including a sound source configured to generate a first sound signal and a second sound signal in accordance with an instruction signal for instructing to produce a sound, a first output unit configured to output a third sound signal containing the first sound signal and not containing the second sound signal, and a second output unit configured to output a fourth sound signal containing the first sound signal and the second sound signal.

DESCRIPTION OF EMBODIMENTS

Figure 1:
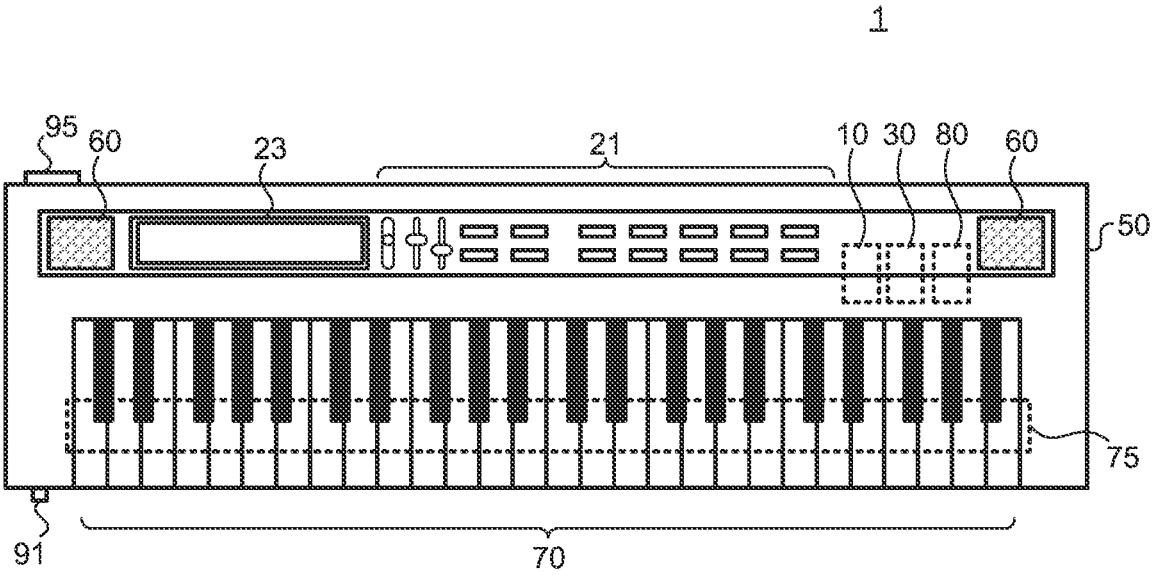
FIG. 1 is a diagram showing a configuration of an electronic keyboard musical instrument according to a first embodiment of the present invention.

In the following, an electronic keyboard musical instrument according to an embodiment of the present invention is described in detail with reference to the drawings. Embodiments to be described below are examples of embodiments of the present invention, and the present invention is not construed within the limitations of these embodiments. It should be noted that in the drawings that are referred to in the present embodiment, identical parts or parts having the same functions are given identical signs or similar signs (signs each formed simply by adding A, B, or the like to the end of a number) and a repeated description thereof may be omitted.

First Embodiment

[Configuration of Keyboard Musical Instrument]

FIG. 1 is a diagram showing a configuration of an electronic keyboard musical instrument according to a first embodiment of the present invention. An electronic keyboard musical instrument 1 is for example an electronic piano, and is an example of an electronic musical instrument having a plurality of keys 70 as playing operators. A user's operation of a key 70 causes a sound to be produced from a speaker 60. Types of sound (timbres) to be produced vary through the use of an operating unit 21. In this example, in producing sounds through the use of the timbre of a piano, the electronic keyboard musical instrument 1 can produce sounds which are close to those of an acoustic piano. In particular, the electronic keyboard musical instrument 1 can reproduce sounds of a piano in which keybed hitting sounds are contained.

Most electronic pianos include speakers for outputting sounds of pianos. The generation of a sound of a piano by the technology disclosed in Patent Literature 1 causes a sound that is outputted from a speaker to contain a keybed hitting sound. Meanwhile, for the realization of a sense of playing which is close to the sense of playing an acoustic piano, a structure which is similar to that of an acoustic piano is sometimes employed as the mechanical structure of parts (key assembly) surrounding keys in an electronic piano. In such a case, there is no need to aggressively employ the technology disclosed in Patent Literature 1, as an actual keybed hitting sound produced is heard by the player, as is the case with an acoustic piano.

In addition to a speaker, an electronic piano includes an output terminal though which a sound signal is outputted to an external device such as a headphone so that the external device produces a sound. Meanwhile, in a case where the player uses the headphone, it becomes hard for the player to hear an actual keybed hitting sound. Accordingly, as compared with a case where the player hears a sound from the speaker, the player has had to hear a sound without a sense of a keybed hitting sound.

Meanwhile, thought is given to a case where the technology disclosed in Patent Literature 1 is employed so that the player can hear a keybed hitting sound even when the player uses the headphone. In this case, using the speaker causes a keybed hitting sound mechanically produced and a keybed hitting sound from the speaker to be heard as an overlapped sound. In either case, the player has had to hear different sounds, depending on the difference between devices that output sounds. Accordingly, the player has had to sense such unnaturalness that sounds vary from hearing environment to hearing environment even when the player does the same performance.

The present invention makes it possible to provide a technology that makes it possible to, despite the difference between devices that output sounds, make sounds to be heard differ as little as possible from each other. The following describes each component of the electronic keyboard musical instrument 1 in detail.

The electronic keyboard musical instrument 1 includes the plurality of key 70 (playing operators). The plurality of keys 70 are rotatably supported by a housing 50. The housing 50 is provided with the operating unit 21, a display unit 23, and the speaker 60 (first output unit). The housing 50 has disposed therein a control unit 10, a storage unit 30, a key behavior measuring unit 75, and a sound source 80. The components disposed in the housing 50 are connected to each other via a bus.

In this example, the electronic keyboard musical instrument 1 includes an interface though which signals are inputted and outputted to and from an external device. Examples of the interface include a terminal through which a sound signal is outputted to the external device, a cable connection terminal through which MIDI data is transmitted and received, and the like. In this example, an output terminal (second output unit) through which a sound signal is outputted includes a headphone terminal 91 to which a headphone is connected as the external device and a LINE terminal 95 through which line output is done.

The control unit 10 includes an arithmetic processing circuit such as a CPU and a storage device such as a RAM or a ROM. The control unit 10 executes, through the CPU, a control program stored in the storage unit 30 and thereby allows the electronic keyboard musical instrument 1 to achieve various types of functions. The operating unit 21 includes devices such as operation buttons, a touch sensor, sliders and outputs, to the control unit 10, a signal corresponding to an operation inputted. The display unit 23 displays a screen based on control exercised by the control unit 10.

The storage unit 30 is a storage device such as a non-volatile memory. The storage unit 30 has stored therein the control program that is executed by the control unit 10. Further, the storage unit 30 may have stored therein parameters, waveform data, and the like that are used in the sound source 80. The speaker 60 amplifies and outputs a sound signal that is outputted from the control unit 10 or the sound source 80 and thereby produces a sound corresponding to the sound signal.

The key behavior measuring unit 75 measures the behavior of each of the plurality of keys 70 and outputs measurement data representing a measurement result. In this example, the measurement data contains information corresponding to a key 70 that has been depressed and an amount of depression (amount of operation) of the key 70. In this example, the key behavior measuring unit 75 is designed to, upon detecting first, second, and third amounts of depression of a key 70, output detection signals corresponding the amounts of depression. The key 70 that has been depressed can be identified by containing information (e.g. a key number) indicating the key 70.

[Configuration of Key Assembly]

Figure 2:
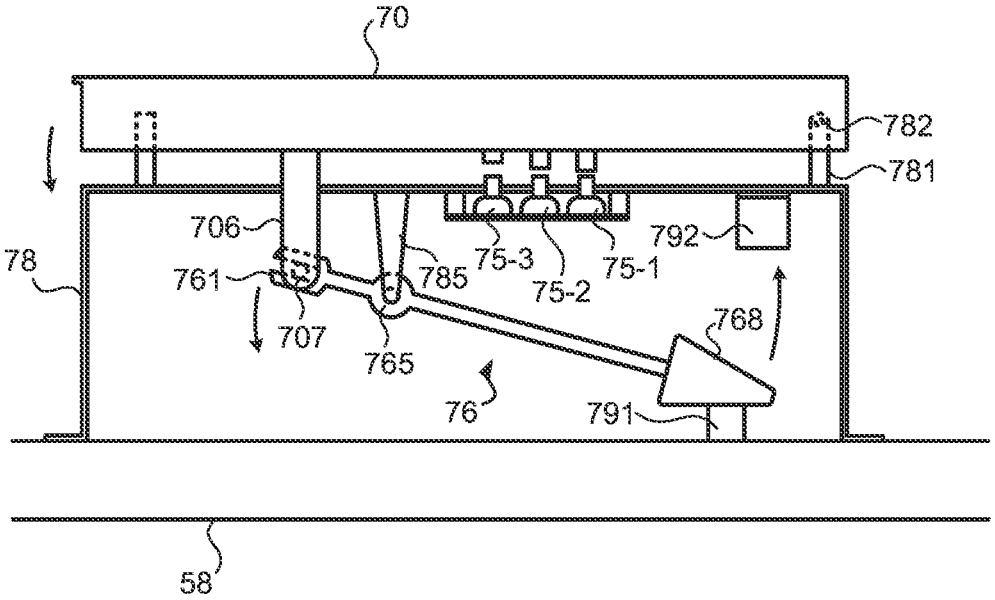
FIG. 2 is a diagram showing a mechanical structure (key assembly) linked with a key according to the first embodiment of the present invention.

FIG. 2 is a diagram showing a mechanical structure (key assembly) linked with a key according to the first embodiment of the present invention. FIG. 2 gives a description by taking as an example a structure associated with a white key of the keys 70. A keybed 58 is a member that constitutes a part of the aforementioned housing 50. A frame 78 is fixed to the keybed 58. A key supporting member 781 projecting upward from the frame 78 is disposed on top of the frame 78. The key supporting member 781 supports the key 70 so that the key 70 can rotate on a spindle 782. A hammer supporting member 785 projecting downward from the frame 78 is disposed. A hammer 76 is disposed on a side of the frame 78 opposite to the key 70. The hammer supporting member 785 supports the hammer 76 so that the hammer 76 can rotate on a spindle 765.

A hammer connecting part 706 projecting toward a lower position than the key 70 includes a coupling part 707 at a lower end thereof. The key connecting part 761 and the coupling part 707, which are disposed at one end of the hammer 76, are slidably connected to each other. The hammer 76 includes a weight 768 (second member) on a side of the spindle 765 opposite to the key connecting part 761. When the key 70 is not being operated, the weight 768 is placed on a lower limit stopper 791 by its own weight.

Meanwhile, depression of the key 70 causes the key connecting part 761 to move downward, and rotation of the hammer 76 causes the weight 768 to move upward. A collision of the weight 768 with an upper limit stopper 792 (first member) restricts the rotation of the hammer 76, so that the key 70 becomes unable to be depressed. A strong depression of the key 70 causes the hammer 76 (weight 768) to hit the upper limit stopper 792, and a hitting sound is produced at that time. This hitting sound may be transmitted to the keybed 58 via the frame 78 and emitted as a louder sound. In the configuration of FIG. 2, this sound is equivalent to a keybed hitting sound.

It should be noted that the key assembly is not limited to the structure shown in FIG. 2, provided it is a structure in which a hitting sound is produced by depressing the key 70. For example, the key assembly may be a structure in which the key 70 directly hits the keybed 58 when depressed. Alternatively, the key assembly may be a structure in which as shown in FIG. 2, depression of the key 70 causes a member that moves in tandem with the key 70 to hit the keybed 58 or a member connected to the keybed 58. In either case, the key assembly needs only be a structure in which depression of the key 70 causes a hitting sound to be produced by the occurrence of a collision in any part.

The key behavior measuring unit 75 (first sensor 75-1, second sensor 75-2, third sensor 75-3) is disposed between the frame 78 and the key 70. Depressing the key 70 causes the first sensor 75-1 to output a first detection signal when the key 70 has reached the first amount of depression. Then, the second sensor 75-2 outputs a second detection signal when the key 70 has reached the second amount of depression. Furthermore, the third sensor 75-3 outputs a third detection signal when the key 70 has reached the third amount of depression. A velocity of depression and acceleration of depression of the key 70 can be calculated from temporal differences in output timing among the detection signals.

In this example, the control unit 10 calculates a first velocity of depression on the basis of the time from the output timing of the first detection signal to the output timing of the second detection signal and predetermined distances (here, distances to the first amount of depression and the second amount of depression). Similarly, the control unit 10 calculates a second velocity of depression on the basis of the time from the output timing of the second detection signal to the output timing of the third detection signal and predetermined distances (here, distances to the second amount of depression and the third amount of depression). The control unit 10 calculates an acceleration of depression on the basis of the first velocity of depression and the second velocity of depression. Furthermore, the control unit 10 outputs a note-on Non to the sound source 80 upon detection of the third detection signal and, after having outputted the note-on Non and upon stoppage of the output of the first detection signal for the same key, outputs a note-off Noff to the sound source 80.

When a note-on Non is outputted, a key number Note, a velocity of depression Vel (the first velocity of depression or the second velocity of depression), and an acceleration of depression Acc are outputted in association with the note-on Non. The key number Note is information for identifying the key 70 that has been depressed, and corresponds to information (pitch information) that designates the pitch of a sound.

On the other hand, when a note-off Noff is outputted, the key number Note is outputted in association with the note-off Noff. It should be noted that in the following description, these pieces of information (operating information) which are outputted from the control unit 10 along with the operation of the key 70 are supplied to the sound source 80 as an instruction signal that gives an instruction to produce a sound.

The description goes on with continued reference to FIG. 1. The sound source 80 generates a sound signal in accordance with an instruction signal, outputted from the control unit 10, that contains a note-on Non, a note-off Noff, a key number Note, a velocity of depression Vel, and an acceleration of depression Acc, and outputs the sound signal to the speaker 60. A sound signal that the sound source 80 generates is obtained for each operation on the key 70. Moreover, a plurality of sound signals obtained by a plurality of key depressions are combined and outputted from the sound source 80. The following describes a configuration of the sound source 80 in detail.

[Configuration of Sound Source]

Figure 3:
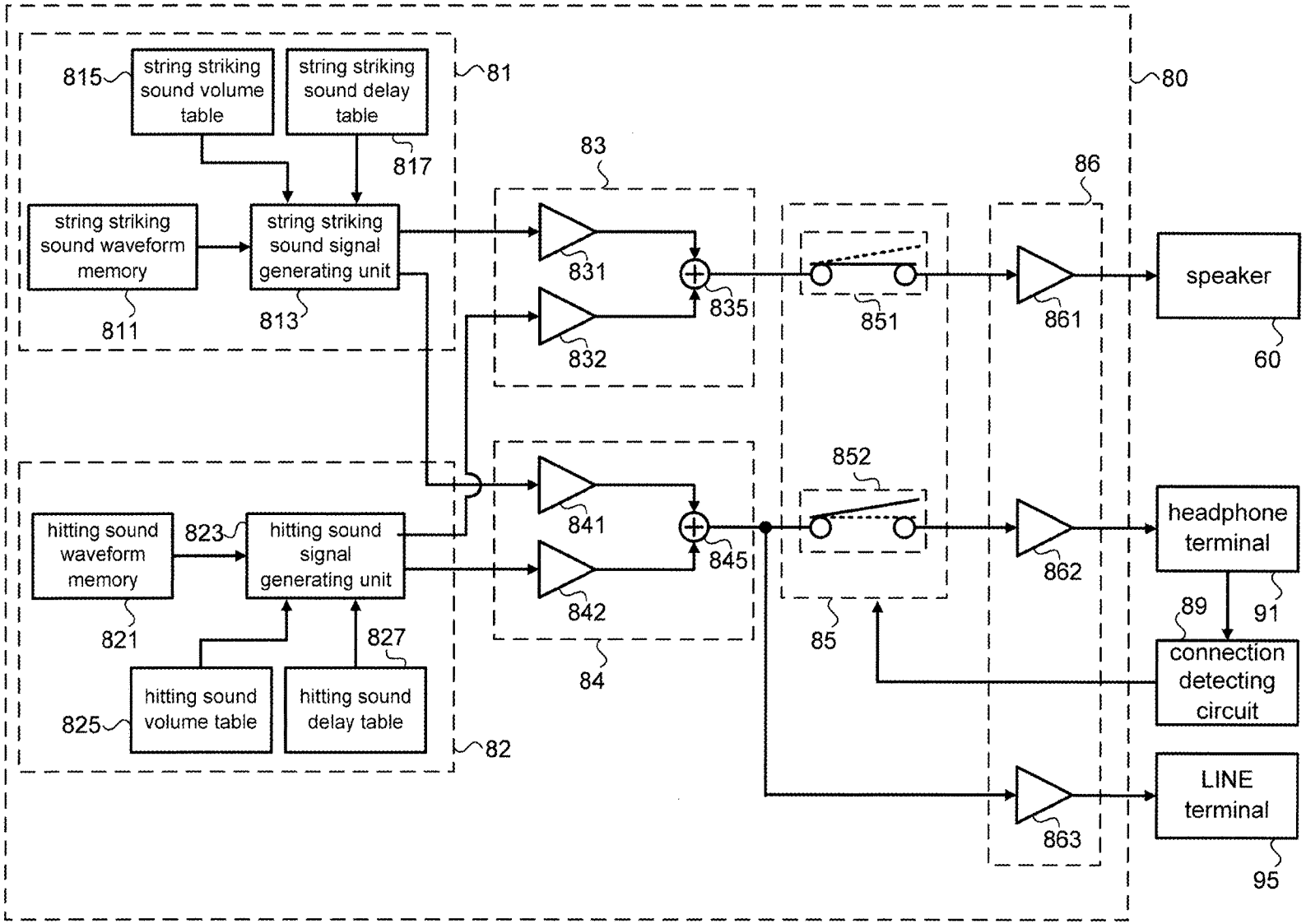
FIG. 3 is a block diagram showing a functional configuration of a sound source according to the first embodiment of the present invention.

FIG. 3 is a block diagram showing a functional configuration of a sound source according to the first embodiment of the present invention. The sound source 80 includes a string striking sound signal output unit 81, a hitting sound signal output unit 82, a speaker output synthesizing unit 83, a terminal output synthesizing unit 84, an output switching unit 85, and an amplified output unit 86.

The string striking sound signal output unit 81 outputs, in accordance with an instruction signal that is supplied in response to depression of a key 70, a sound signal (string striking sound signal: first sound signal) that is equivalent to a string striking sound of a piano. The string striking sound signal output unit 81 includes a string striking sound waveform memory 811, a string striking sound signal generating unit 813, a string striking sound volume table 815, and a string striking sound delay table 817.

The string striking sound waveform memory 811 has stored therein waveform data representing string striking sounds of a piano. This waveform data is waveform data obtained by sampling sounds of an acoustic piano (i.e. sounds produced by string striking entailed by key depression). In this example, waveform data of different pitches are stored in association with key numbers.

The string striking sound signal generating unit 813 reads out waveform data from the string striking sound waveform memory 811 in accordance with an instruction signal, subjects the waveform data to envelope processing, which is for example controlled by ADSR parameters, and outputs the waveform data as a string striking sound signal. The string striking sound signal is outputted to the speaker output synthesizing unit 83 and the terminal output synthesizing unit 84.

The string striking sound signal generating unit 813 determines, on the basis of the key number Note, the pitch of the waveform data to be read out. This causes the string striking sound signal generating unit 813 to generate a string striking sound signal having a pitch corresponding to the key number Note. That is, in a case where the key number Note has changed by a predetermined pitch difference, the pitch of the string striking sound signal changes according to this pitch difference. The string striking sound signal generating unit 813 determines the sound volume (maximum amplitude) of the string striking sound signal with reference to the string striking sound volume table 815. The string striking sound signal generating unit 813 determines a delay time from reception of an instruction signal representing a note-on Non to outputting of a string striking sound signal with reference to the string striking sound delay table 817. The timing of generation (timing of production) of the string striking sound signal changes according to this delay time. The string striking sound volume table 815 and the string striking sound delay table 817 will be described in detail later.

The hitting sound signal output unit 82 outputs, in accordance with an instruction signal that is supplied in response to depression of a key 70, a sound signal (hitting sound signal: second sound signal) that is equivalent to a keybed hitting sound. The hitting sound signal output unit 82 includes a hitting sound waveform memory 821, a hitting sound signal generating unit 823, a hitting sound volume table 825, and a hitting sound delay table 827.

The hitting sound waveform memory 821 has stored therein waveform data representing keybed hitting sounds of a piano. This waveform data is waveform data obtained by sampling keybed hitting sounds entailed by depression of keys of an acoustic piano. Unlike the string striking waveform memory 811, which has waveform data stored therein, the hitting sound waveform memory 821 does not have stored therein waveform data whose pitches vary according to key number. That is, the hitting sound waveform memory 821 has common waveform data stored therein regardless of key number.

The hitting sound signal generating unit 823 reads out waveform data from the hitting sound waveform memory 821 in accordance with an instruction signal and outputs the waveform data as a hitting sound signal. The hitting sound signal is outputted to the speaker output synthesizing unit 83 and the terminal output synthesizing unit 84. It should be noted that although, in this example, envelope processing is not performed on the hitting sound signal, it may be performed. In a case where envelope processing is not performed, the hitting sound waveform memory 821 has stored therein waveform data of a predetermined period of time. Upon reading out waveform data in accordance with an instruction signal for a predetermined period of time, the hitting sound signal generating unit 823 finishes generating a hitting sound signal corresponding to this instruction signal.

The hitting sound signal generating unit 823 determines the sound volume (maximum amplitude) of the hitting sound signal with reference to the hitting sound volume table 825. The hitting sound signal generating unit 823 determines a delay time from reception of an instruction signal representing a note-on Non to outputting of a hitting sound signal with reference to the hitting sound delay table 827. The timing of generation (timing of production) of the hitting sound signal changes according to this delay time. It should be noted that in this example, in which the hitting sound waveform memory 821 does not have stored therein waveform data of different pitches, the hitting sound signal generating unit 823 does not need to use the key number Note. That is, the pitch of the hitting sound signal does not change even when the key number Note changes by a predetermined pitch difference.

The following describes specific contents of each table (string striking sound volume table 815, hitting sound volume table 825, string striking sound delay table 817, hitting sound delay table 827).

Figure 4:
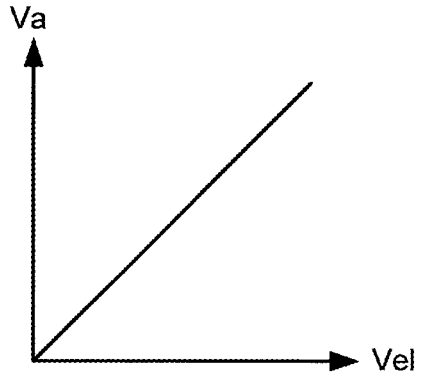
FIG. 4 is a diagram explaining a string striking sound volume table according to the first embodiment of the present invention.

FIG. 4 is a diagram explaining a string striking sound volume table according to the first embodiment of the present invention. As shown in FIG. 4, the string striking sound volume table defines a relationship between a velocity of depression Vel and a string striking sound volume Va. In this example, the higher the velocity of depression Vel becomes, the higher the string striking sound volume Va becomes. It should be noted that although, in the example shown in FIG. 4, the velocity of depression Vel and the string striking sound volume Va are defined by a relationship that can be expressed by a linear function, it is possible to adopt any relationship within a limit of a relationship that the string striking sound volume Va can be determined with respect to the velocity of depression Vel. Further, the string striking sound volume Va may be determined by using the acceleration of depression Acc instead of the velocity of depression Vel or using a combination of the velocity of depression Vel and the acceleration of depression Acc.

Figure 5:
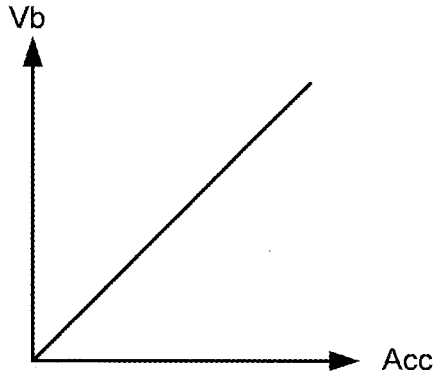
FIG. 5 is a diagram explaining a hitting sound volume table according to the first embodiment of the present invention.

FIG. 5 is a diagram explaining a hitting sound volume table according to the first embodiment of the present invention. As shown in FIG. 5, the hitting sound volume table defines a relationship between the acceleration of depression Acc and a hitting sound volume Vb. In this example, the higher the acceleration of depression Acc becomes, the higher the hitting sound volume Vb becomes. It should be noted that although, in the example shown in FIG. 5, the acceleration of depression Acc and the hitting sound volume Vb are defined by a relationship that can be expressed by a linear function, it is possible to adopt any relationship within a limit of a relationship that the hitting sound volume Vb can be determined with respect to the acceleration of depression Acc. Further, the hitting sound volume Vb may be determined by using the velocity of depression Vel instead of the acceleration of depression Acc or using a combination of the velocity of depression Vel and the acceleration of depression Acc.

Figure 6:
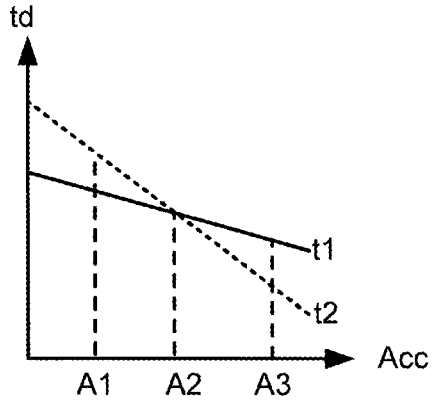
FIG. 6 is a diagram explaining a string striking sound delay table and a hitting sound delay table according to the first embodiment of the present invention.

FIG. 6 is a diagram explaining a string striking sound delay table and a hitting sound delay table according to the first embodiment of the present invention. Both tables define a relationship between the acceleration of depression Acc and a delay time td. FIG. 6 shows the string striking sound delay table 817 and the hitting sound delay table 827 in contrast with each other. The string striking sound delay table 817 defines a relationship between the acceleration of depression Acc and the delay time td (hereinafter referred to as "string striking sound delay time t1"). The hitting sound delay table 827 defines a relationship between the acceleration of depression Acc and the delay time td (hereinafter referred to as "hitting sound delay time t2"). In either table, the higher the acceleration of depression Acc becomes, the shorter the delay time td (t1, t2) becomes.

When the acceleration of depression Acc is A2, the string striking sound delay time t1 and the hitting sound delay time t2 become equal to each other. When the acceleration of depression Acc is A1, which is smaller than A2, the hitting sound delay time t2 becomes a longer time than the string striking sound delay time t1. On the other hand, when the acceleration of depression Acc is A3, which is larger than A2, the hitting sound delay time t2 becomes a shorter time than the string striking sound delay time t1. A2 may be "0". In this case, A1 takes on a negative value and indicates gradual deceleration during depression. On the other hand, A3 takes on a positive value and indicates gradual acceleration during depression.

It should be noted that although, in the example shown in FIG. 6, the acceleration of depression Acc and the delay time td are defined by a relationship that can be expressed by a linear function, it is possible to adopt any relationship within a limit of a relationship that the delay time td can be determined with respect to the acceleration of depression Acc. Further, the delay time td may be determined by using the velocity of depression Vel instead of the acceleration of depression Acc or using a combination of the velocity of depression Vel and the acceleration of depression Acc.

Figure 7:
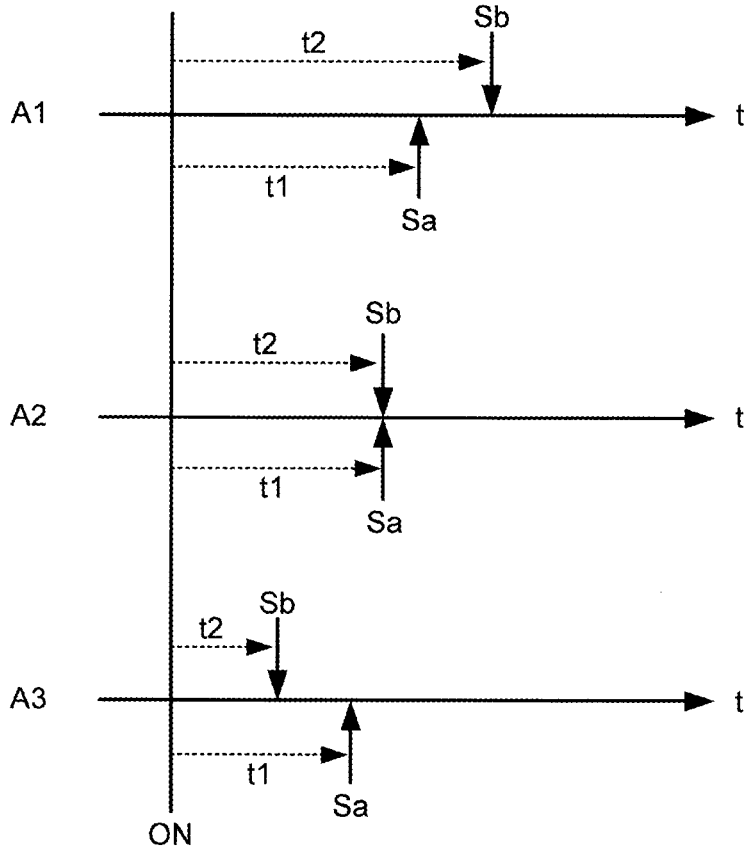
FIG. 7 is a diagram explaining timings of production of string striking sounds and hitting sounds with respect to note-on's according to the first embodiment of the present invention.

FIG. 7 is a diagram explaining timings of production of string striking sounds and hitting sounds with respect to note-on's according to the first embodiment of the present invention. A1, A2, and A3 in FIG. 7 correspond to values of the acceleration of depression Acc in FIG. 6. That is, the relationship among the accelerations of depression is defined as A1<A2<A3. A time signal is indicated along each horizontal axis. The sign "ON" denotes a timing of reception of an instruction signal representing a note-on Non. The sign "Sa" denotes a timing of start of generation of a string striking sound signal, and the sign "Sb" denotes a timing of start of generation of a hitting sound signal. Accordingly, the string striking sound delay time t1 corresponds to the time from "ON" to "Sa". The hitting sound delay time t2 corresponds to the time from "ON" to "Sb". As shown in FIG. 7, the higher the acceleration of depression becomes, the less the timings of generation of both the string striking sound signal and the hitting sound signal lag behind the note-on Non. Furthermore, the hitting sound signal is larger in proportion of change in timing of generation than the string striking sound signal. Accordingly, a relative relationship between the timing of generation of the string striking sound signal and the timing of generation of the hitting sound signal changes according to the acceleration of depression.

The foregoing has described each table. As mentioned above, the string striking sound signal generating unit 813 determines, on the basis of the key number Note, the pitch of the waveform data to be read out. On the other hand, in this example, the hitting sound signal generating unit 823 does not allow the pitch of the waveform data to be read out to change according to the key number Note.

Figure 8:
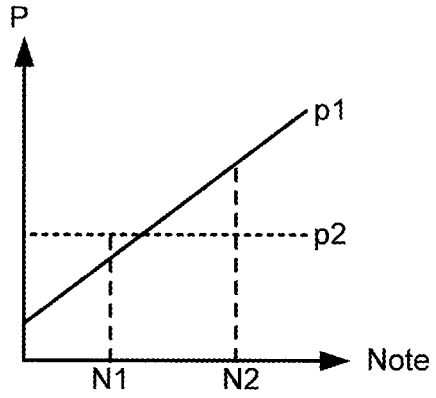
FIG. 8 is a diagram explaining a relationship between the pitches of a string striking sound and a hitting sound with respect to note numbers according to the first embodiment of the present invention.

FIG. 8 is a diagram explaining a relationship between the pitches of a string striking sound and a hitting sound with respect to note numbers according to the first embodiment of the present invention. FIG. 8 shows a relationship between the key number Note and the pitch P. FIG. 8 shows the pitch p1 of a string striking sound and the pitch p2 of a hitting sound in contrast with each other. A change in the key number Note leads to a change in the pitch p1 of a string striking sound. On the other hand, even a change in the key number Note does not lead to a change in the pitch p2 of a hitting sound. In other words, the pitch p1 of a string striking sound varies from a case where the key number Note is N1 to a case where the key number Note is N2. On the other hand, the pitch p2 of a hitting sound remains the same in both a case where the key number Note is N1 and a case where the key number Note is N2. It should be noted that the pitch p1 of a string striking sound and the pitch p2 of a hitting sound as shown in FIG. 8 indicate their respective trends of change with respect to the key number Note and do not indicate a magnitude relationship between them.

The description goes on with continued reference to FIG. 3. The speaker output synthesizing unit 83 includes amplifying units 831 and 832 and a synthesizing unit 835. The amplifying unit 831 amplifies, by a predetermined amplification factor, a string striking sound signal outputted from the string striking sound signal generating unit 813. The amplifying unit 832 amplifies, by a predetermined amplification factor, a hitting sound signal outputted from the hitting sound signal generating unit 823. The synthesizing unit 835 combines by addition the string striking sound signal amplified by the amplifying unit 831 and the hitting sound signal amplified by the amplifying unit 832 and outputs them. These configurations cause the speaker output synthesizing unit 83 to output a speaker sound signal (third sound signal) made by combining the string striking sound signal and the hitting sound signal at a predetermined first sound volume ratio.

The terminal output synthesizing unit 84 includes amplifying units 841 and 842 and a synthesizing unit 845. The amplifying unit 841 amplifies, by a predetermined amplification factor, a string striking sound signal outputted from the string striking sound signal generating unit 813. The amplifying unit 842 amplifies, by a predetermined amplification factor, a hitting sound signal outputted from the hitting sound signal generating unit 823. The synthesizing unit 845 combines by addition the string striking sound signal amplified by the amplifying unit 841 and the hitting sound signal amplified by the amplifying unit 842 and outputs them. These configurations cause the terminal output synthesizing unit 84 to output a terminal sound signal (fourth sound signal) made by combining the string striking sound signal and the hitting sound signal at a predetermined second sound volume ratio. It should be noted that in the following description, the first sound volume ratio and the second sound volume ratio both refer to the proportion of the maximum amplitude (which corresponds to the hitting sound volume Vb) of the hitting sound signal to the maximum amplitude (which corresponds to the string striking sound volume Va) of the string striking sound signal.

Figure 9:
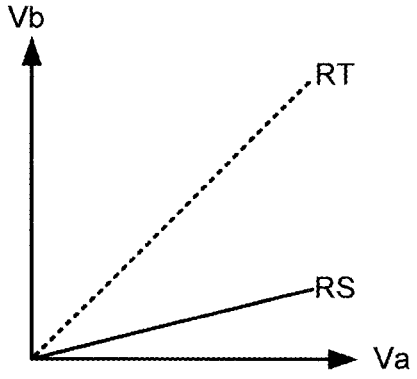
FIG. 9 is a diagram explaining the sound volume ratio between a string striking sound and a hitting sound according to the first embodiment of the present invention.

FIG. 9 is a diagram explaining the sound volume ratio between a string striking sound and a hitting sound according to the first embodiment of the present invention. FIG. 9 shows a relationship RS between the string striking sound volume Va and the hitting sound volume Vb in a speaker sound signal and a relationship RT between the string striking sound volume Va and the hitting sound volume Vb in a terminal sound signal. The proportion of the hitting sound volume Vb to the string striking sound volume Va corresponds to the tilt of each of the relationships. The tilt of the relationship RS is equivalent to the first sound volume ratio. The tilt of the relationship RT is equivalent to the second sound volume ratio. That is, the ratio between the amplification factors of the amplifying units 831 and 832 in the speaker output synthesizing unit 83 is set by a value corresponding to the tilt of the relationship RS. Further, the ratio between the amplification factors of the amplifying units 841 and 842 in the terminal output synthesizing unit 84 is set by a value corresponding to the tilt of the relationship RT.

As shown in FIG. 9, the second sound volume ratio (relationship RT) is greater than the first sound volume ratio (relationship RS). It should be noted that the first sound volume ratio and the second sound volume ratio need only satisfy this relationship and may be changed by using the operating unit 21. Further, the first sound volume ratio (relationship RS) may be defined as 0. That is, the proportion of the hitting sound signal (hitting sound volume Vb) to the string striking sound signal (string striking sound volume Va) may be 0. In this case, a configuration of the aftermentioned second embodiment may be employed.

The description goes on with continued reference to FIG. 3. The output switching unit 85 includes switches 851 and 852. The switch 851 is provided on a path (hereinafter referred to as "speaker path") of a sound signal from the speaker output synthesizing unit 83 to the speaker 60. The switch 852 is provided on a path (hereinafter referred to as "headphone path") of a sound signal from the terminal output synthesizing unit 84 to the headphone terminal 91. As shown in FIG. 3, in a case where no plug is connected to the headphone terminal 91, the output switching unit 85 turns on the switch 851 to connect the speaker path and turns off the switch 852 to disconnect the headphone path. On the other hand, in a case where a predetermined detection signal has been supplied from a connection detecting circuit 89, the output switching unit 85 turns off the switch 851 to disconnect the speaker path and turns on the switch 852 to connect the headphone path. The predetermined detection signal is a signal that the connection detecting circuit 89 outputs when a connecting plug such as a headphone is connected to the headphone terminal 91.

It should be noted that a sound signal (terminal sound signal) that is outputted from the terminal output synthesizing unit 84 is also supplied to the LINE terminal 95. In this example, a path (hereinafter referred to as "LINE path") of a sound signal from the terminal output synthesizing unit 84 to the LINE terminal 95 does not include a switch of the output switching unit 85. That is, the terminal sound signal to the LINE terminal is always supplied.

The amplified output unit 86 includes amplifying units 861, 862, and 863. The amplifying unit 861 is provided on the speaker path. The amplifying unit 862 is provided on the headphone path. The amplifying unit 863 is provided on the LINE path. The amplifying units 861, 862, and 863 are set at a predetermined amplification factor. The setting of this amplification factor can be changed by operating a volume knob or the like of the operating unit 21.

The aforementioned configuration causes the sound source 80 to output the speaker sound signal through the speaker 60 and outputs the terminal sound signal, which contains more components of a hitting sound signal than the speaker sound signal, through the headphone terminal 91 and the LINE terminal 95. A sound that is outputted from the speaker 60 is combined with a hitting sound that is mechanically produced from the key assembly, and is heard by the player. Therefore, even when the output from the speaker 60 contains few or no components of a hitting sound signal, the player can hear a keybed hitting sound.

On the other hand, in using the headphone terminal 91, the player hardly hears a mechanically-produced hitting sound. Since a sound that is outputted from the headphone terminal 91 contains many components of a hitting sound signal, the aforementioned sound source 80 enables the player to hear a hitting sound produced by the sound source 80 instead of a mechanical hitting sound.

Second Embodiment

In the first embodiment, in a case where a sound that is outputted from the speaker 60 does not contain a hitting sound signal, i.e. a case where the first sound volume ratio is 0, the amplification factor of the amplifying unit 842 is achieved by being set to 0. In a second embodiment, this is achieved by a different configuration.

Figure 10:
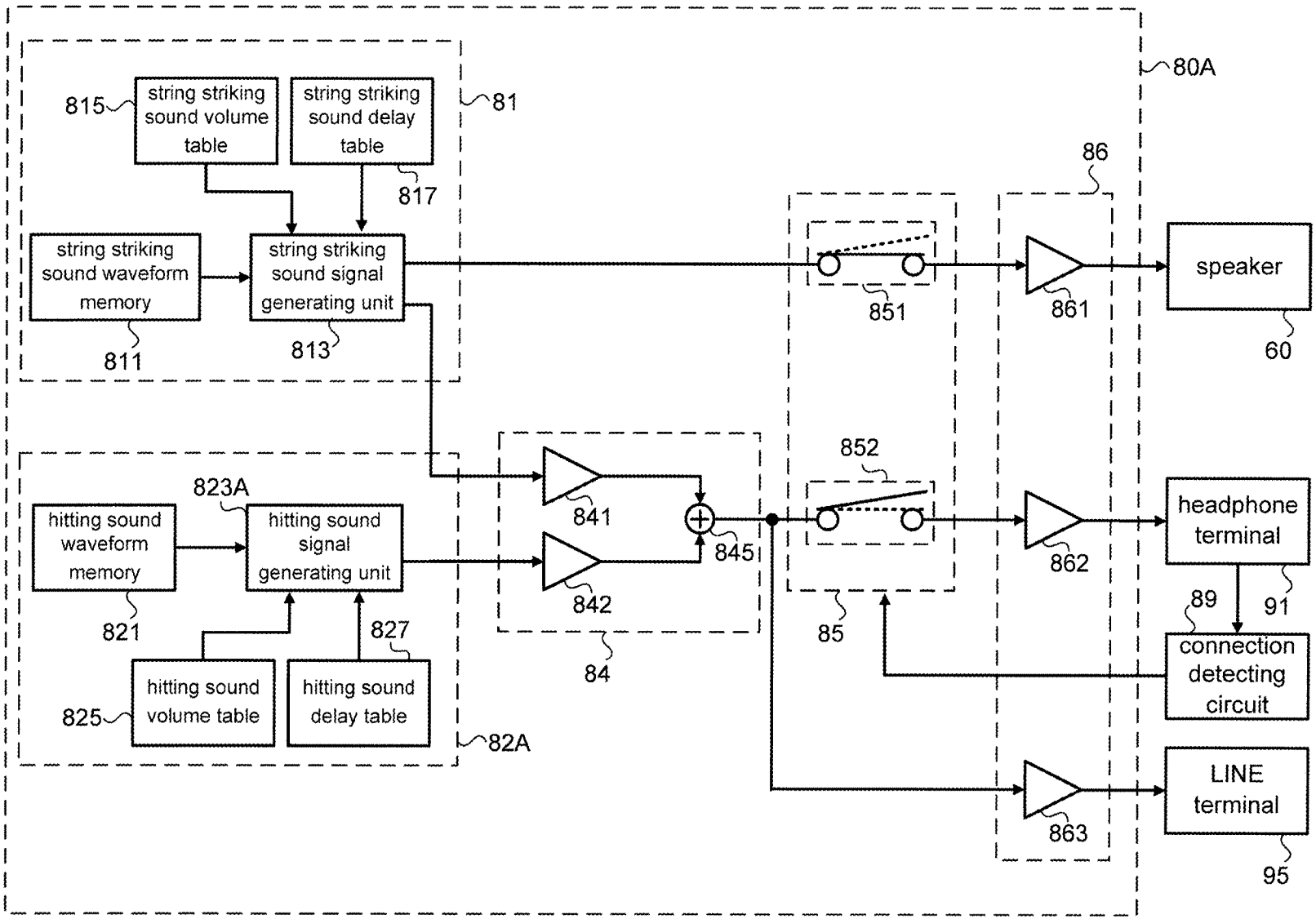
FIG. 10 is a block diagram showing a functional configuration of a sound source according to a second embodiment of the present invention.

FIG. 10 is a block diagram showing a functional configuration of a sound source according to the second embodiment of the present invention. In comparison with the sound source 80 according to the first embodiment, a sound source 80A according to the second embodiment does not include the speaker output synthesizing unit 83. Accordingly, a string striking sound signal from the string striking sound signal output unit 81 (string striking sound signal generating unit 813) is outputted to the output switching unit 85 (switch 851) and the terminal output synthesizing unit 84 (amplifying unit 841). On the other hand, a hitting sound signal from a hitting sound signal output unit 82A (hitting sound signal generating unit 823A) is outputted to the terminal output synthesizing unit 84 (amplifying unit 842), as the speaker output synthesizing unit 83 is not present. The other components are the same as those of the first embodiment. It should be noted that a relationship between the amplification factors of the amplifying units 841 and 842 needs only be determined in advance.

Third Embodiment

Still another sound may be added to a sound that is outputted from the speaker 60 according to the first embodiment. In a third embodiment, an example is described in which a reverberation sound signal (fifth sound signal) that corresponds to reverberation at the time of transmission of a keybed hitting sound to the soundboard or the like of a grand piano is added.

Figure 11:
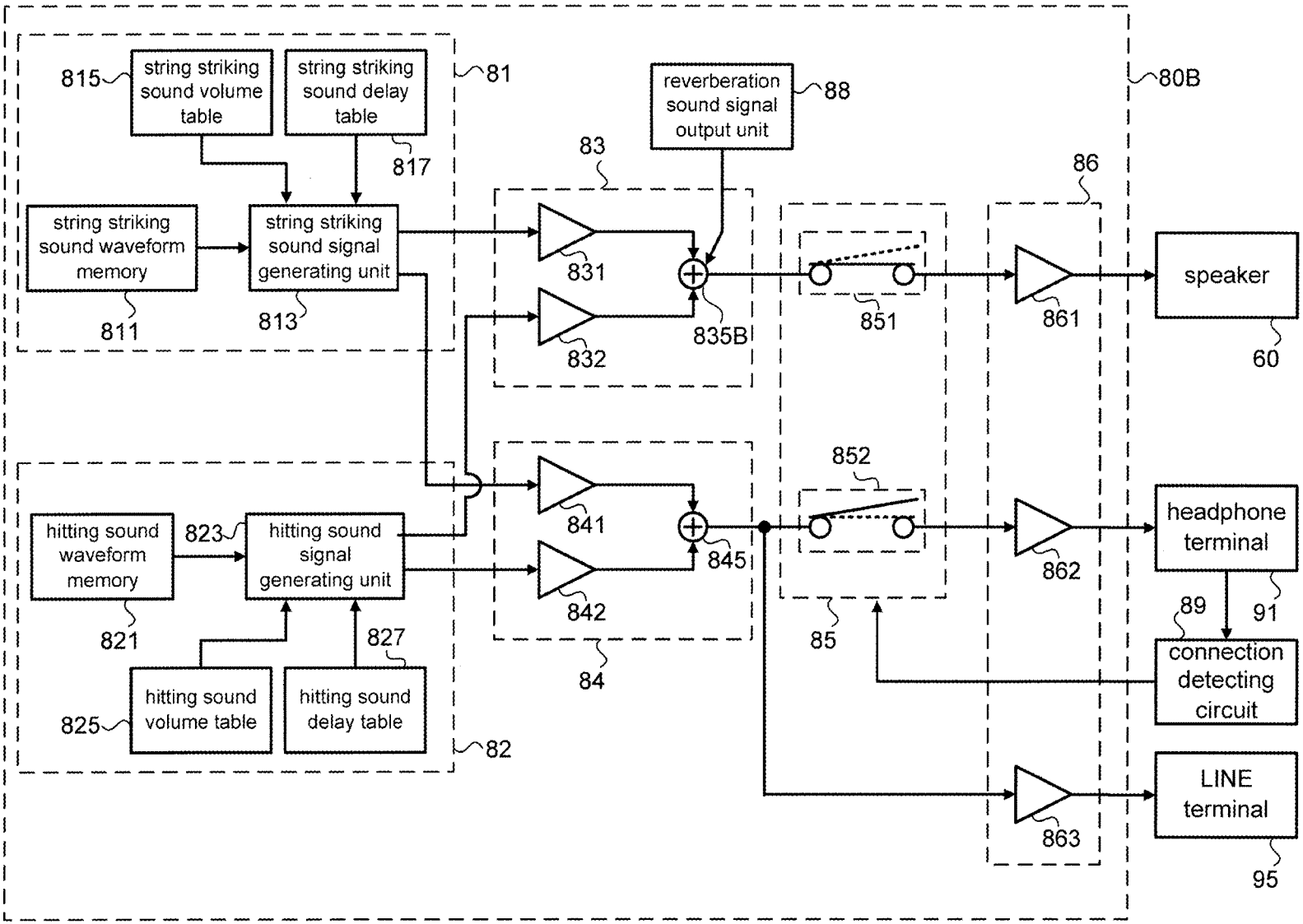
FIG. 11 is a block diagram showing a functional configuration of a sound source according to a third embodiment of the present invention.

FIG. 11 is a block diagram showing a functional configuration of a sound source according to the third embodiment of the present invention. In comparison with the sound source 80 according to the first embodiment, a sound source 80B according to the third embodiment further includes a reverberation sound signal output unit 88. The reverberation sound signal output unit 88 outputs a reverberation sound signal by a process which is similar to that by which the hitting sound signal output unit 82 outputs a hitting sound signal. In this case, the timing of generation of the reverberation sound signal corresponds to a reverberation component of the hitting sound and therefore lags behind the timing of generation of the hitting sound signal. This delay time needs only be set in advance. A synthesizing unit 835B of a speaker output synthesizing unit 83B combines a string striking sound signal, a hitting sound signal, and a reverberation sound signal. Such a configuration causes a speaker sound signal to be a signal containing a reverberation sound signal as well as a string striking sound signal and a hitting sound signal.

As mentioned above, a sound that is outputted from the speaker 60 is combined with a hitting sound that is mechanically produced from the key assembly, and is heard by the player. The electronic keyboard musical instrument 1 does not include a large structure such as a soundboard in comparison with an acoustic piano. Therefore, a hitting sound that is mechanically produced in the electronic keyboard musical instrument 1 may contain fewer reverberation components than a hitting sound of an acoustic piano. In this example, a reverberation sound signal represents a sound that is equivalent to such a reverberation component. Accordingly, a reverberation component of a hitting sound of an acoustic piano can be reinforced by a sound (speaker sound signal) that is outputted from the speaker 60. Since a terminal sound signal contains extra components of a hitting sound signal, the hitting sound signal in itself may contain a reverberation component.

It should be noted that since a hitting sound signal contains a reverberation component, too, control may be exercised so that the larger amplification factor the amplifying unit 831 is set at, the smaller the sound volume of a reverberation sound signal that is outputted from the reverberation sound signal output unit 88 becomes. Further, in a case where the first sound volume ratio is 0, a configuration in which the amplifying unit 832 is not used may be set up, or the second embodiment may be provided with a synthesizing unit that combines a string striking sound signal and a reverberation sound signal by addition.

<Modifications>

In the foregoing, embodiments of the present invention have been described. However, the embodiments may employ embodiments combined or replaced with each other. Further, the embodiments of the present invention may be modified into various forms as below. The modifications to be described below can also be applied in combination with each other.

(1) In each of the aforementioned embodiments, the sound volume ratio between a string striking sound signal and a hitting sound signal in a terminal sound signal that is supplied to the headphone terminal 91 and the sound volume ratio between a string striking sound signal and a hitting sound signal in a terminal sound signal that is supplied to the LINE terminal 95 are equal to each other. Alternatively, these sound volume ratios may be different from each other.

(2) In each of the aforementioned embodiments, the electronic keyboard musical instrument 1 has been described as an example of an electronic musical instrument. Alternatively, instead of being a keyboard musical instrument, the electronic musical instrument needs only be a musical instrument having a playing operator. That is, the electronic musical instrument may be configured to include a playing operator other than the keys 70. The sound source according to any of the aforementioned may be applied to an electronic musical instrument assuming the form of an acoustic musical instrument in which a hitting sound is produced by operating a playing operator. A possible example of a hitting sound that is produced in a woodwind instrument is a sound of a lid being opened and closed by a key operation. In a case where such a woodwind instrument takes the form of an electronic musical instrument, it is effective to have a structure in which a hitting sound is produced by an operation on a playing operator and then apply the sound source according to any of the aforementioned embodiments.

(3) In each of the aforementioned embodiments, the supply of a sound signal to either the speaker 60 or the headphone terminal 91 is achieved by switching paths by means of the output switching unit 85. Alternatively, this may be achieved by adjusting the amplification factors of the amplifying units 861 and 862 and restricting output to either of them.

(4) In each of the aforementioned embodiments, the hitting sound waveform memory 821 has common waveform data stored therein regardless of key number. Alternatively, as is the case with the waveform data stored in the string striking sound waveform memory 811, different pieces of waveform data may be stored with respect to a key number, and the same waveform data may be associated with at least two key numbers (namely a key number representing a first pitch and a key number representing a second pitch).

(5) In each of the aforementioned embodiments, the electronic keyboard musical instrument 1 includes the speaker 60. Alternatively, instead of including the speaker 60, the electronic keyboard musical instrument 1 may include a terminal through which a sound signal is supplied to the speaker. In this case, a speaker sound signal needs only be supplied to this terminal.

(6) In each of the aforementioned embodiments, a string striking sound signal and a hitting sound signal are generated at different timings. Alternatively, these signals may be generated at the same time.

(7) In each of the aforementioned embodiments, even a change in the key number Note by a predetermined pitch difference does not lead to a change in the pitch of a hitting sound signal. Alternatively, this pitch may change. In this case, the pitch of a hitting sound signal may change in a manner similar to the pitch of a string striking sound signal or may change by a smaller pitch difference than a string striking sound signal. Thus, in a case where the key number Note has changed by a predetermined pitch difference, the pitch of a string striking sound signal and the pitch of a hitting sound signal need only be different in magnitude of the change from each other.

(8) In each of the aforementioned embodiments, the sound source generates and combines a string striking sound signal and a hitting sound signal. Alternatively, such a combination does not impose any limitation, provided two types of sound signal are generated and combined.

REFERENCE SIGNS LIST

1 . . . electronic keyboard musical instrument, 10 . . . control unit, 21 . . . operating unit, 23 . . . display unit, 30 . . . storage unit, 50 . . . housing, 58 . . . keybed, 60 . . . speaker, 75 . . . key behavior measuring unit, 75-1 . . . first sensor, 75-2 . . . second sensor, 75-3 . . . third sensor, 76 . . . hammer, 78 . . . frame, 80 . . . sound source, 81 . . . string striking sound signal output unit, 82 . . . hitting sound signal output unit, 83 . . . speaker output synthesizing unit, 84 . . . terminal output synthesizing unit, 85 . . . output switching unit, 86 . . . amplified output unit, 89 . . . connection detecting circuit, 91 . . . headphone terminal, 95 . . . LINE terminal, 706 . . . hammer connecting part, 707 . . . coupling part, 761 . . . key connecting part, 765 . . . spindle, 768 . . . weight, 781 . . . key supporting member, 782 . . . spindle, 785 . . . hammer supporting member, 791 . . . lower limit stopper, 792 . . . upper limit stopper, 811 . . . string striking sound waveform memory, 813 . . . string striking sound signal generating unit, 815 . . . string striking sound volume table, 817 . . . string striking sound delay table, 821 . . . hitting sound waveform memory, 823 . . . hitting sound signal generating unit, 825 . . . hitting sound volume table, 827 . . . hitting sound delay table, 831, 832 . . . amplifying unit, 841, 842 . . . amplifying unit, 851,852 . . . switch, 861, 862, 863 . . . amplifying unit

What is claimed is:

1. An electronic musical instrument comprising:

a sound source configured to generate a first sound signal and a second sound signal in accordance with an instruction signal;

a first output unit configured to output a third sound signal containing the first sound signal and the second sound signal at a first sound volume ratio; and a second output unit configured to output a fourth sound signal containing the first sound signal and the second sound signal at a second sound volume ratio that is different from the first sound volume ratio, wherein the first sound signal corresponds to a string striking sound, and the second sound signal corresponds to a keybed hitting sound, and wherein the first output unit is configured not to output the third sound signal while the second output unit outputs the fourth sound signal.

2. The electronic musical instrument according to claim 1, wherein:

the instruction signal contains pitch information for designating a pitch of a sound to be produced, in a case where the pitch information has changed from a first pitch to a second pitch that is different from the first pitch, the sound source is configured to effect a change in a pitch of the first sound signal in correspondence with a pitch difference between the first pitch and the second pitch and to either not effect a change in a pitch of the second sound signal or effect the change in the pitch of the second sound signal in correspondence with a pitch difference that is less than the change in the pitch of the first sound signal, and a proportion of the second sound signal to the first sound signal at the second sound volume ratio is larger than the proportion of the second sound signal to the first sound signal at the first sound volume ratio.

3. The electronic musical instrument according to claim 1, further comprising a playing operator configured to generate the instruction signal, wherein:

the instruction signal contains operating information corresponding to an operation of the playing operator, in response to the instruction signal, the sound source is configured to change a relative relationship between a timing of generation of the first sound signal and a timing of generation of the second sound signal in accordance with the operating information, and a proportion of the second sound signal to the first sound signal at the second sound volume ratio is larger than the proportion of the second sound signal to the first sound signal at the first sound volume ratio.

4. The electronic musical instrument according to claim 1, wherein a proportion of the second sound signal to the first sound signal is 0 at the first sound volume ratio.

5. The electronic musical instrument according to claim 1, wherein:

the first output unit is a speaker configured to output the third sound signal as a sound, and the second output unit is an output terminal configured to output the fourth sound signal to an external device.

6. The electronic musical instrument according to claim 5, wherein in a case where the external device is connected to the output terminal, the third sound signal is not output from the speaker.

7. The electronic musical instrument according to claim 5, wherein in a case where the external device is not connected to the output terminal, the fourth sound signal is not output from the output terminal.

8. The electronic musical instrument according to claim 1, further comprising:

a playing operator configured to generate the instruction signal; and a first member that the playing operator, or a second member linked with the playing operator, hits to produce a hitting sound in response to an operation of the playing operator.

9. The electronic musical instrument according to claim 8, wherein:

the playing operator includes a key, and the first member is a keybed or a member connected to the keybed.

10. The electronic musical instrument according to claim 8, wherein the second sound signal corresponds to a sound that corresponds to the hitting sound.

11. The electronic musical instrument according to claim 1, wherein:

the sound source is further configured to generate a fifth sound signal, the third sound signal that is outputted from the first output unit further contains the fifth sound signal, and a timing of generation of the fifth sound signal lags behind a timing of generation of the second sound signal.

12. The electronic musical instrument according to claim 1, wherein the first sound volume ratio and the second sound volume ratio are each a ratio of a sound volume of the keybed hitting sound to a sound volume of the string striking sound.

13. An electronic musical instrument comprising:

a sound source configured to generate a first sound signal and a second sound signal in accordance with an instruction signal;

a first output unit configured to output a third sound signal containing the first sound signal and not containing the second sound signal; and a second output unit configured to output a fourth sound signal containing the first sound signal and the second sound signal, wherein the first sound signal corresponds to a string striking sound, and the second sound signal corresponds to a keybed hitting sound, and wherein the first output unit is configured not to output the third sound signal while the second output unit outputs the fourth sound signal.

14. The electronic musical instrument according to claim 13, wherein:

the instruction signal contains pitch information for designating a pitch of a sound to be produced, and in a case where the pitch information has changed from a first pitch to a second pitch that is different from the first pitch, the sound source is configured to effect a change in a pitch of the first sound signal in correspondence with a pitch difference between the first pitch and the second pitch and to either not effect a change in a pitch of the second sound signal or effect the change in the pitch of the second sound signal in correspondence with a pitch difference that is less than the change in the pitch of the first sound signal.

15. The electronic musical instrument according to claim 13, further comprising a playing operator configured to generate the instruction signal, wherein:

the instruction signal contains operating information corresponding to an operation of the playing operator, and in response to the instruction signal, the sound source is configured to change a relative relationship between a timing of generation of the first sound signal and a timing of generation of the second sound signal in accordance with the operating information.

16. The electronic musical instrument according to claim 13, wherein:

the first output unit is a speaker configured to output the third sound signal as a sound, and the second output unit is an output terminal configured to output the fourth sound signal to an external device.

17. The electronic musical instrument according to claim 16, wherein in a case where the external device is connected to the output terminal, the third sound signal is not output from the speaker.

18. The electronic musical instrument according to claim 16, wherein in a case where the external device is not connected to the output terminal, the fourth sound signal is not output from the output terminal.

19. The electronic musical instrument according to claim 13, further comprising:

a playing operator configured to generate the instruction signal; and a first member that the playing operator, or a second member linked with the playing operator, hits to produce a hitting sound in response to an operation of the playing operator.

20. The electronic musical instrument according to claim 19, wherein:

the playing operator includes a key, and the first member is a keybed or a member connected to the keybed.

21. The electronic musical instrument according to claim 13, wherein:

the sound source is further configured to generate a fifth sound signal, the third sound signal that is outputted from the first output unit further contains the fifth sound signal, and a timing of generation of the fifth sound signal lags behind a timing of generation of the second sound signal.

22. An electronic musical instrument comprising:

a sound source configured to generate a first sound signal and a second sound signal in accordance with an instruction signal;

a first output unit configured to output a third sound signal containing the first sound signal and the second sound signal at a first sound volume ratio; and a second output unit configured to output a fourth sound signal containing the first sound signal and the second sound signal at a second sound volume ratio that is different from the first sound volume ratio, wherein:

the instruction signal contains pitch information for designating a pitch of a sound to be produced, in a case where the pitch information has changed from a first pitch to a second pitch that is different from the first pitch, the sound source is configured to effect a change in a pitch of the first sound signal in correspondence with a pitch difference between the first pitch and the second pitch and to either not effect a change in a pitch of the second sound signal or effect the change in the pitch of the second sound signal in correspondence with a pitch difference that is less than the change in the pitch of the first sound signal, and a proportion of the second sound signal to the first sound signal at the second sound volume ratio is larger than the proportion of the second sound signal to the first sound signal at the first sound volume ratio.

23. An electronic musical instrument comprising:

a sound source configured to generate a first sound signal and a second sound signal in accordance with an instruction signal;

a first output unit configured to output a third sound signal containing the first sound signal and not containing the second sound signal; and a second output unit configured to output a fourth sound signal containing the first sound signal and the second sound signal, wherein:

the instruction signal contains pitch information for designating a pitch of a sound to be produced, and in a case where the pitch information has changed from a first pitch to a second pitch that is different from the first pitch, the sound source is configured to effect a change in a pitch of the first sound signal in correspondence with a pitch difference between the first pitch and the second pitch and to either not effect a change in a pitch of the second sound signal or effect the change in the pitch of the second sound signal in correspondence with a pitch difference that is less than the change in the pitch of the first sound signal.

* * * * *